United States Patent [19]

Wong

[11] 4,322,782

[45] Mar. 30, 1982

[54] FLASHLIGHT

[76] Inventor: Kwan Wong, 42 Sunrise Ave., Grafton, Mass. 01519

[21] Appl. No.: 153,337

[22] Filed: May 27, 1980

[51] Int. Cl.[3] ..... F21L 7/00

[52] U.S. Cl. ..... 362/183; 362/205; 362/253; 362/802

[58] Field of Search ..... 362/183, 205, 253, 802

[56] References Cited

U.S. PATENT DOCUMENTS 4,045,663 8/1977 Young ..... 362/253

*Primary Examiner*—Stephen J. Lechert, Jr.

*Attorney, Agent, or Firm*—Norman S. Blodgett; Gerry A. Blodgett

[57] ABSTRACT

Flashlight with means permitting operation in a voltage mode with memory, in a conductivity mode, and in a lighting mode.

2 Claims, 2 Drawing Figures

FLASHLIGHT

BACKGROUND OF THE INVENTION

In the installation of residential electrical wiring, there is seldom a need for complex electronic measuring instruments. On the contrary, the functions that are most necessary are a means of determining if a particular point in the system carries 110-volt electricity, and whether there is simple conductivity between two points in the system. In addition, it is necessary to provide illumination, since a great deal of the work is accomplished in recesses and dark areas. Attempts have been made in the past to provide all three of these functions in one unit, particularly in a flashlight. One difficulty has always been that it is difficult to make contact with two leads and still be able to observe the bulb in the flashlight, particularly if the flashlight is at the same time being used to illuminate the work area. The difficulty with the prior art devices has been that, when the contacts between the leads and the two points whose voltage is being investigated are released, the indicating lamp (which is the bulb of the flashlight) turns off. These and other difficulties experienced with the prior art devices have been obviated in a novel manner by the present invention.

It is, therefore, an outstanding object of the invention to provide a flashlight capable of operating in a voltage mode with a memory.

Another object of this invention is the provision of a flashlight, including the three functions of lighting, voltage indicating, and conductivity indicating in one unit.

It is another object of the instant invention to provide a flashlight having leads to indicate the presence of voltage between two points by lighting the bulb of the flashlight, the bulb remaining in lighted condition even after contact by the leads has been removed.

A still further object of the invention is the provision of a flashlight for indicating the presence of voltage, wherein the presence of voltage lights up the bulb, the bulb remaining lit until positively released by the user.

It is a further object of the invention to provide a flashlight in which the conventional on-and-off switch is also used to convert from voltage mode to conductivity mode.

It is still a further object of the present invention to provide a flashlight having leads for indicating voltage or conductivity which, when wrapped around the housing and connected together, permit the apparatus to be used for lighting purposes in the conventional manner.

With these and other objects in view, as will be apparent to those skilled in the art, the invention resides in the combination of parts set forth in the specification and covered by the claims appended hereto.

SUMMARY OF THE INVENTION

In general, the flashlight is provided with a housing incorporating an electrical circuit having a low-voltage bulb, a low-voltage battery, and a silicon controlled rectifier connected in series. The rectifier has its anode connected to one side of the bulb and its cathode connected to one side of the battery. A first probe is connected to the gate of the rectifier and a second probe is connected to the cathode of the rectifier.

More specifically, a normally-closed switch is mounted electrically between the said cathode and the said one side of the battery to interrupt the flow of current through the rectifier on occasion. A second switch is connected on one side to the said gate and said first probe and connected on the other side to one side of the bulb. The probes have connecting elements permitting them to be selectively electrically joined.

BRIEF DESCRIPTION OF THE DRAWINGS

The character of the invention, however, may be best understood by references to one of its structural forms, as illustrated by the accompanying drawings, in which.

DESCRIPTION OF THE PREFERRED EMBODIMENT

Figure 1:
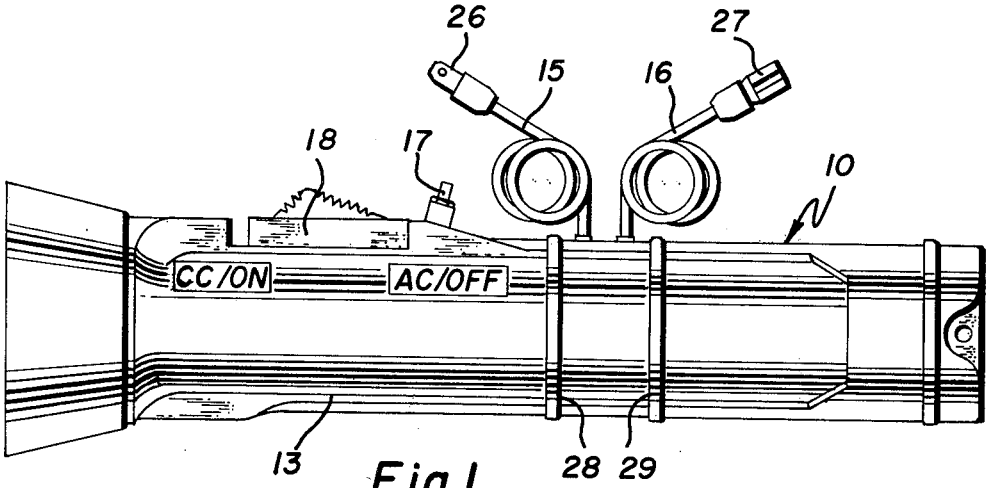
FIG. 1 is a side elevational view of a flashlight incorporating the principles of the present invention.

Referring first to FIG. 1, it can be seen that the flashlight, indicated generally by the reference numeral 10, has an elongated housing of the conventional type. Extending to the exterior of the housing are a switch 18, a switch 17, a probe 15, and a probe 16. The probes 15 and 16 are provided with connecting elements 26 and 27, respectively, at their extreme ends and the housing is provided with two spaced ridges 28 and 29 defining a storage space for the probes.

Figure 2:
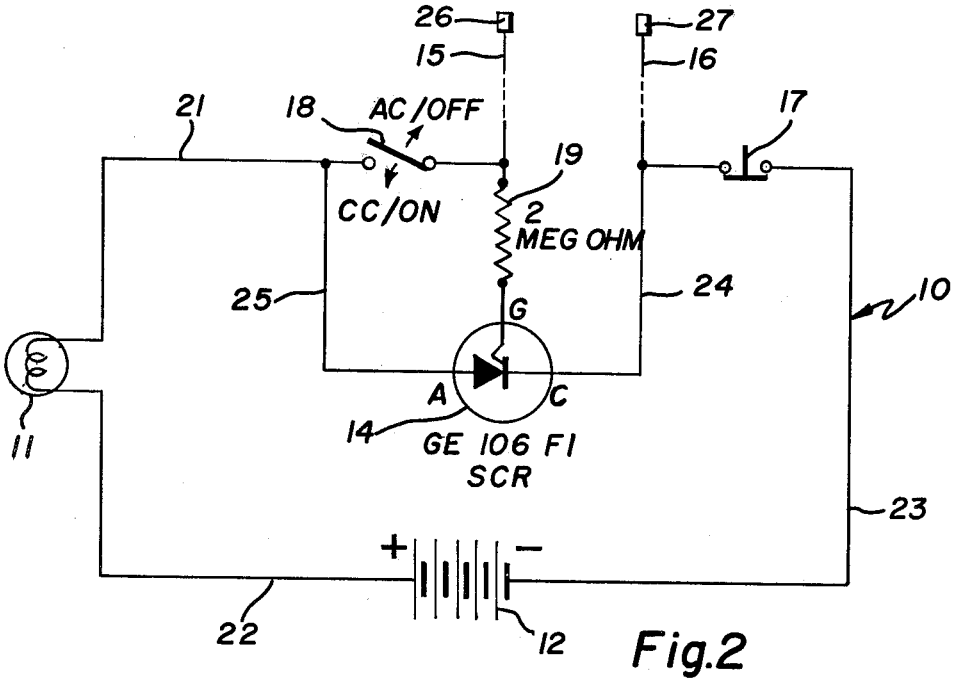
FIG. 2 is a schematic view of the electric circuitry contained in the flashlight.

Referring to FIG. 2, it can be seen that the electrical circuitry which is mounted in the housing 13, includes a low-voltage bulb 11, a low-voltage battery 12, and a solid state element such as a silicon controlled rectifier 14 connected in series. The rectifier has its anode A connected to one side of the bulb 11 and its cathode C connected to one side of the battery 12. The first probe 15 is connected to the gate G of the rectifier 14, and the second probe 16 is connected to the cathode C of the rectifier.

The switch 17 is normally closed and is connected electrically in a line 23 joining the cathode C to the battery 12. The switch 18 is connected on one side to the said gate G of the rectifier and to the said first probe 15, while it is connected on the other side through a line 21 to one side of the bulb 11. A resistor 19 is connected between the gate G and the first probe 15. The second switch 18 when in "open" condition places the electrical circuitry in a VOLTAGE MODE in which the anode and cathode are placed in series with the battery 12 and the bulb 11 and in which direct or alternating current voltage across the first and second probes 15 and 16 causes current to flow from the battery through the rectifier 14 and through the bulb 11 to light the same. If direct current is measured, the positive side should be connected to probe 15. The current continues to flow and to light the bulb until the normally-closed switch 17 is opened.

The electrical circuitry is placed in a CONTINUITY MODE by placing the second switch 18 in "closed" condition. In addition, the first and second probes 15 and 16 are provided with cooperating connecting elements 26 and 27, respectively, which, when joined together, place the electrical circuitry in a "LIGHTING MODE". In that mode the opening and closing of the switch 18 by its movement to the "off" and "on" positions causes the bulb 11 and associated elements to operate in the normal manner as a flashlight.

In a practical version of the invention, the battery 12 is a 4.5 volt battery, the rectifier 14 is a G.E. 106 Fl and the resistor 19 is 2 megohms.

The operation of the invention and its advantages will now be readily understood in view of the above description. It is contemplated that the two leads 15 and 16 would normally be wrapped around the housing 13 of the flashlight between the ridges 28 and 29 with their connecting elements 26 and 27 firmly joined together. In that condition the flashlight can be operated as a flashlight and the movement of the switch 18 from "OFF" to "ON" causes the current to pass from the battery 12 through the lead 22, through the bulb 11, through the lead 21, the switch 18, the probe 15 and its connecting element 26 to the connecting element 27 and the probe 16, through the switch 17, the lead 23 to the battery again. In that condition, (LIGHTING MODE) the flashlight operates in the normal manner as a flashlight.

When the connecting elements 26 and 27 are separated, the switch 18 becomes a selector switch to select between the VOLTAGE MODE and a CONDUCTIVITY MODE. When the switch 18 is at the right (in FIG. 1), it is in its open condition. When the connecting elements 26 and 27 then are placed on two separate electrical positions, the device indicates whether an AC voltage (or D.C. if the polarity is correct) is present or not. If a voltage is present, it is felt on the gate G, which causes current to pass from the anode A to the cathode C of the rectifier 14. This current continues to flow, even when the connecting elements 26 and 27 are removed from the test area. Current continues to flow from the battery 12, through the lead 22, the bulb 11, the lead 21, the lead 25, the rectifier 14, the lead 24, the switch 17 and the lead 23 back to the battery. In other words, the circuitry has a "memory" which maintains the bulb in lighted condition. In this way, the measurement can be made in an inaccessible area where it is difficult for the electrician to observe the bulb 11. After he has made contact, however, he can then look at the bulb to see whether it is in lighted condition, indicating that he has just found a AC or DC voltage difference between the two points that he has touched. When the electrician has observed that the lamp 11 is in lighted condition (indicating that voltage is present between the two points contacted by the connecting elements 26 and 27), he can then restore the apparatus to its original condition by opening the circuit by pushing the normally closed switch 17. This interrupts the circuit to the rectifier 14 and restores it to unconducting condition.

When the switch 18 has been moved to the left in FIG. 1, it is then in closed condition. The electrical circuitry is then in CONDUCTIVITY MODE and, if the probes 15 and 16 are placed in an electrical circuit having no voltage on it, by contacting the connecting elements 26 and 27 at two points in question, the bulb 11 will light up if there is a completed circuit between the two points. This occurs because current is allowed to flow from the battery 12, through the lead 22, the bulb 11, the lead 21, the switch 18, the probe 15 and the connecting element 26, through the circuit in question to the connecting elements 27, the probe 16, the switch 17, the lead 23 back to the battery, thus causing the bulb 11 to be lighted.

It can be seen, therefore, that the present invention involves a flashlight that is very practical for use by an electrician, since it can be used not only in its normal way as a lighting element, but also to indicate the presence or lack of presence of voltage as well as to check conductivity. It accomplishes these functions with a device that is simple and rugged in construction, that can be readily manufactured from inexpensive materials, and that is capable of a long life of useful service with a minimum of maintenance.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Flashlight, comprising:

(a) a low-voltage bulb, (b) a low-voltage direct-current battery, (c) a housing in which the bulb and battery are mounted, (d) a silicon controlled rectifier mounted in the housing and having its anode connected to one side of the bulb and its cathode connected to one side of the battery, (e) a first probe for contacting an electrical circuit to be tested, the probe being connected to the gate of the rectifier, (f) a second probe for contacting the circuit to be tested, the probe being connected to the cathode of the rectifier, (g) a normally-closed switch mounted on the exterior of the housing and connected electrically between the said cathode and the said one side of the battery, (h) a second switch mounted on the exterior of the housing and connected on one side to the said gate and said first probe and connected on the other side to one side of the bulb, and (i) a resistor connected between the said gate and the first probe, wherein the second switch when in open condition places the electrical circuitry in a VOLTAGE MODE in which anode and cathode are placed in series with the battery and bulb and voltage across the first and second probes causes current to flow from the battery through the bulb and through the rectifier to light the same, the current continuing to flow and light the bulb until the normally-closed switch is opened and wherein the electrical circuitry is placed in a CONTINUITY MODE by placing the second switch in closed condition.

2. Flashlight as recited in claim 1, wherein the first and second probes are provided with cooperating connecting elements and wherein the electrical circuitry is placed in LIGHTING MODE by joining the connecting elements.

* * * * *